US008336436B2

(12) United States Patent
Kincel

(10) Patent No.: US 8,336,436 B2
(45) Date of Patent: Dec. 25, 2012

(54) AMBIDEXTROUS CAM STYLE CHARGING HANDLE

(75) Inventor: Eric Stephen Kincel, Tucson, AZ (US)

(73) Assignee: Abrams Airborne Inc.

( * ) Notice: Subject to any disclaimer, the term of this patent is extended or adjusted under 35 U.S.C. 154(b) by 0 days.

(21) Appl. No.: 13/373,024

(22) Filed: Nov. 2, 2011

(65) Prior Publication Data

US 2012/0291612 A1 Nov. 22, 2012

Related U.S. Application Data

(63) Continuation-in-part of application No. 12/928,301, filed on Dec. 8, 2010, now abandoned, which is a continuation-in-part of application No. 12/460,001, filed on Jul. 10, 2009, now Pat. No. 8,104,393.

(51) Int. Cl.
*F41A 7/02* (2006.01)

(52) U.S. Cl. ..... 89/1.14; 89/191.01; 42/16

(58) Field of Classification Search ..... 89/1.4, 89/191.01, 191.02, 179, 192, 1.42; 42/16, 42/69.01, 69.02
See application file for complete search history.

(56) References Cited

U.S. PATENT DOCUMENTS

| | | | | |
|---|---|---|---|---|
| 3,225,653 | A * | 12/1965 | Packard | 89/1.4 |
| 6,311,603 | B1 * | 11/2001 | Dunlap | 89/1.4 |
| 7,231,861 | B1 * | 6/2007 | Gauny et al. | 89/1.4 |
| 7,240,600 | B1 * | 7/2007 | Bordson | 89/1.4 |
| 7,444,775 | B1 * | 11/2008 | Schuetz | 42/76.01 |
| D614,718 | S * | 4/2010 | Hoel | D22/108 |
| 7,707,921 | B1 * | 5/2010 | Hoel | 89/1.4 |
| 7,832,322 | B1 * | 11/2010 | Hoel | 89/1.4 |
| 7,861,635 | B1 * | 1/2011 | Hoel | 89/1.4 |
| 7,900,546 | B2 * | 3/2011 | Bordson | 89/1.4 |
| 8,104,393 | B2 * | 1/2012 | Kincel | 89/1.14 |
| 8,261,649 | B2 * | 9/2012 | Fitzpatrick et al. | 89/1.4 |
| 2006/0026883 | A1 * | 2/2006 | Hochstrate et al. | 42/75.01 |
| 2010/0162604 | A1 * | 7/2010 | Dubois | 42/18 |
| 2011/0174139 | A1 * | 7/2011 | Olsen et al. | 89/1.4 |
| 2011/0226120 | A1 * | 9/2011 | Fitzpatrick et al. | 89/1.4 |

* cited by examiner

*Primary Examiner* — Bret Hayes
*Assistant Examiner* — Joshua Freeman
(74) *Attorney, Agent, or Firm* — Mark Ogram

(57) ABSTRACT

A charging handle for a firearm which can be used by either a right-handed or a left handed operator. The charging handle uses a rod member which engages the action of the firearm and is secured to the action via a locking mechanism. The locking mechanism is release when the handle is pulled by either the left hand or the right hand of the operator by pressing a first pressure surface when the left hand is used, and by pressing a second pressure surface when the right hand is used by the operator. This pressure forces the locking mechanism to disengage from the action mechanism.

15 Claims, 8 Drawing Sheets

FIG. 9B
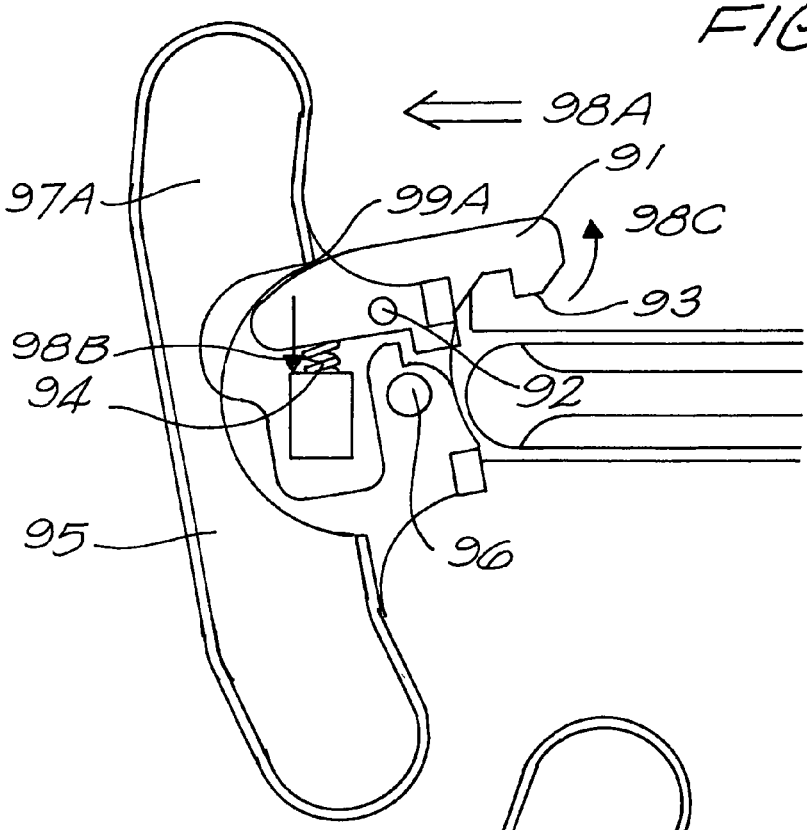
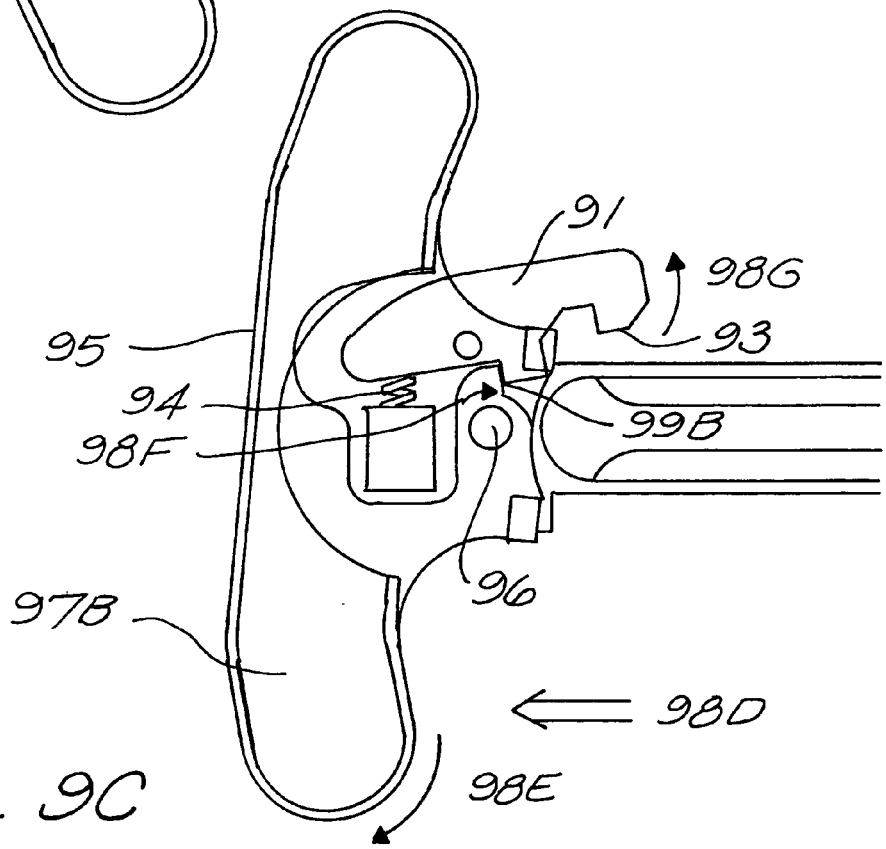
FIG. 9C

AMBIDEXTROUS CAM STYLE CHARGING HANDLE

This is a continuation-in-part of U.S. patent application Ser. No. 12/928,301 filed on Dec. 8, 2010, and entitled "Ambidextrous Cam Style Charging Handle" now abandoned, which was a continuation-in-part of U.S. patent application Ser. No. 12/460,001, entitled "Improved Charging Handle" filed on Jul. 10, 2009 now U.S. Pat. No. 8,104,393.

BACKGROUND OF THE INVENTION

This invention relates generally to firearms and more particularly to a charging handle associated therewith.

For many modern firearms, a charging handle is used to engage the bolt assembly of the firearm so that a preliminary cartridge is loaded into the action. This charging handle is typically mounted parallel with the bolt assembly and is manually operated to pull the bolt assembly to insert the first cartridge. Once the first cartridge is loaded, the charging handle is latched to the firearm as the firing of the first cartridge produces gas pressure to load the second and subsequent cartridges.

The charging handle utilizes a handle portion which was originally designed to be grasped by the operator using two fingers, one placed on each side of the pull rod. In the pulling action, the latch is pulled back into a slot in the handle portion, thereby releasing the charging handle so that it can be withdrawn to load the cartridge.

While this technique works well, it does require the use of two fingers and that the weapon be moved off target for the initial charging. To eliminate these problems, paddles or strike pads were added by extending them from the latch. In operation, the user, using one finger or the back of the hand, presses the paddle backwards while the weapon remains on target. This movement against the paddle releases the latch and pulls the charging handle backwards to load the weapon.

Unfortunately, this arrangement forces the latch to rotate abnormally with all of the force on the latch mechanism, thereby placing a great deal of stress on the pin used to secure the latch to the handle portion. This stress manifests itself in rapid metal fatigue of the pin and a twisting motion in the latch.

It is clear there is a need for an improved charging handle.

SUMMARY OF THE INVENTION

The invention relates to a charging handle assembly for a firearm. Those of ordinary skill in the art readily recognize the use of a charging handle. Examples of such apparatus are described in: U.S. Pat. No. 5,351,598, entitled "Gas-Operated Rifle System" issued to Schuetz on Oct. 4, 1994; U.S. Pat. No. 5,448,940, entitled "Gas-Operated M16 Pistol" issued to Schuetz et al. on Sep. 12, 1995; U.S. Pat. No. 5,551,179, entitled "Bolt Carrier" issued to Young on Sep. 3, 1996; U.S. Pat. No. 5,499,569, entitled "Gas-Operated Rifle System" issued to Schuetz on Mar. 19, 1996; and, U.S. Pat. No. 7,461,581, entitled "Self-Cleaning Gas Operating System for a Firearm" issued to Leitner-Wise on Dec. 9, 2008, all of which are incorporated hereinto by reference.

The invention is an assembly which includes a handle mechanism having a pull rod to engage an action of a firearm. At one end of the assembly is a handle allowing the operator to manually operate the charging mechanism. On the handle portion of the charging handle is a stop surface.

A latch mechanism is rotationally secured to the handle and is meant to be manually activated to disengage the mechanism from the firearm, thereby allowing the charging handle to be pulled to load the weapon with a cartridge. The latch mechanism is secured to the handle via a pin.

When the latch mechanism is moved to an open position, a surface of the latch mechanism contacts the stop surface of the handle mechanism. In this manner, pressure from the user's operation of the charging handle is transferred from the pin to the contact between the latch mechanism and the stop surface.

In the preferred embodiment of the invention, a second stop surface is also used on the handle portion. This second stop surface engages a secondary portion of the latch substantially simultaneously with the contact between the initial stop surface and the latch mechanism.

This preferred embodiment significantly strengthens the charging handle so that metal fatigue and torque is all but eliminated.

A spring mechanism is used to maintain the latch mechanism in a closed position. The spring is held within a cavity of the handle and presses against a surface of the latch mechanism.

Some embodiments of the invention relate to the creation of ambidextrous charging handle. Various attempts have been made to create an effective ambidextrous pull rod such as that described in U.S. Pat. No. 7,240,600, entitled "Rifle Charging Handle with Ambidextrous Latch" issued to Bordson on Jul. 10, 2007, incorporated hereinto by reference.

In one embodiment of the invention, there is an action mechanism together with a charging handle for a firearm in which the charging handle is configured to be used by either a right handed or a left handed user. This embodiment is especially useful for military applications allowing a firearm configured with a single pull rod to be used easily by either left or right-handed soldiers.

In this particularly embodiment, as discussed earlier, the rod member has one end configured to engage the action mechanism such that a rearward movement of the rod member causes the action to accept a bullet and place the bullet in position to be fired.

At the opposing end of the charging handle is a handle mechanism which uses two rotationally mounted levers. These levers are positioned across from each other and are accessible easily by either a right or left-handed user.

In this embodiment, one lever works independently of the other, the other lever, when worked, engaging the first lever to move the rod into an unlocked condition. This is accomplished by using two overlapping fingers. When one of the levers is used, it moves independently without moving the other finger (associated with the opposing lever); but, the other lever only works in conjunction with its mate.

In a further embodiment of the invention, the firearm action assembly employs an action mechanism with another improved charging handle. As before, the charging handle uses a rod member to engage the action for "cocking" the action mechanism.

At an open end of the rod member is a handle which is secured to the edge of the action in a dormant state. Releasing of the lock for the charging handle is through the use of either of two finger members which are swivelly secured to each other such that pressure on either finger member forces the lock into an "open" state.

In yet another embodiment of the invention, a charging handle is created for a firearm which can be used by either a right-handed or a left handed operator. As before, the charging handle uses a rod member which engages the action of the firearm and is secured to the action via a locking mechanism.

In this embodiment, the locking mechanism is released when the handle is pulled by either the left hand or the right hand of the operator by pressing a first pressure surface when the left hand is used, and by pressing a second pressure surface when the right hand is used by the operator. These pressure surfaces are positioned on the locking mechanism on either sides of the pivot point which secures the locking mechanism to the charging handle. In this manner, by using two different pressure surfaces, disengagement is assured when either hand is used to pull the charging handle.

Since the pressure forces the locking mechanism to disengage from the action mechanism, the charging handle is easily moved by the operator.

The invention, together with various embodiments thereof will be more fully explained by the accompanying drawings and the following description thereof.

DRAWINGS IN BRIEF

Figure 6A:
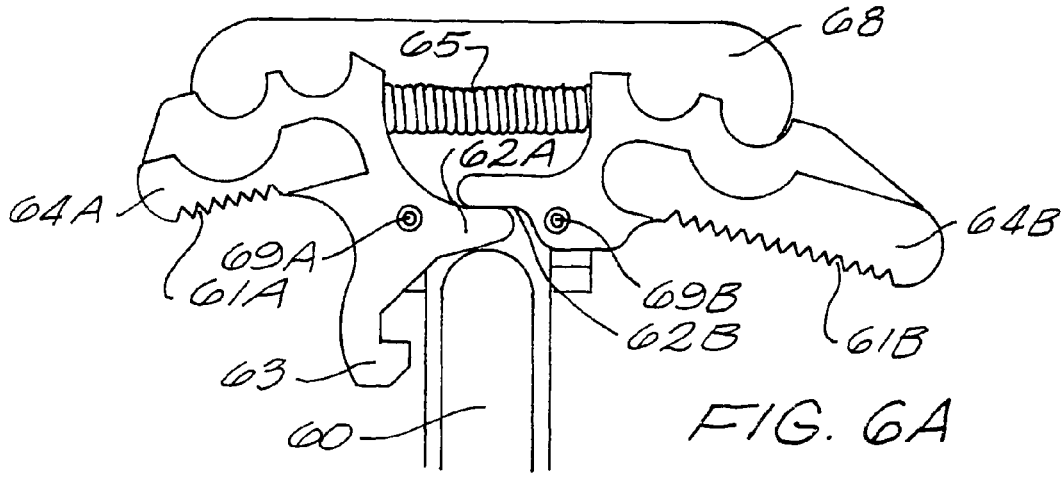
Figure 6B:
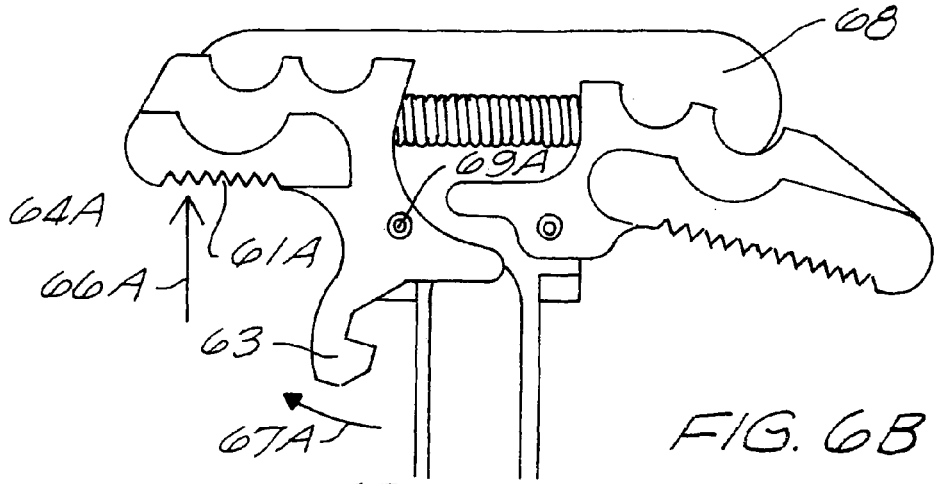
Figure 6C:
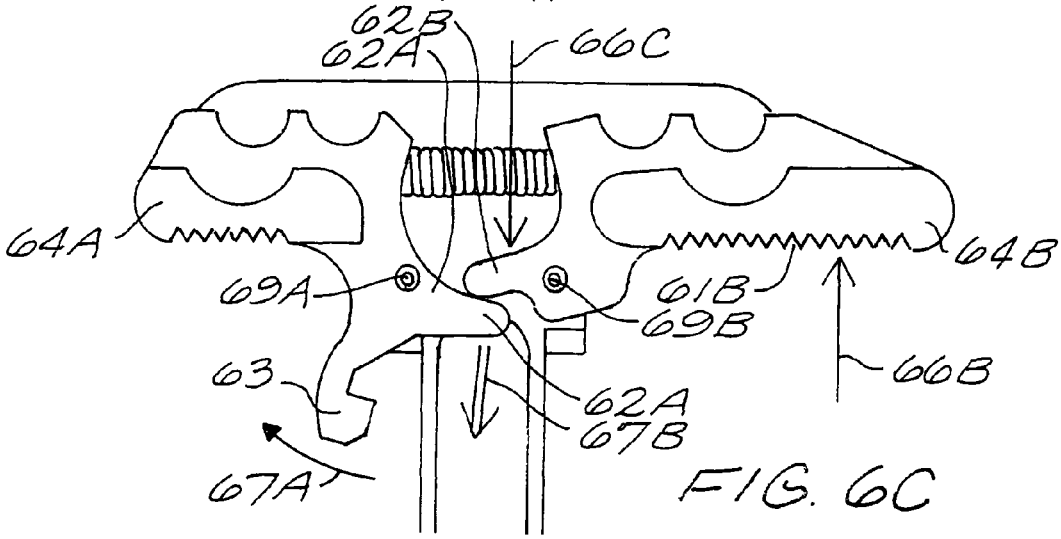

FIGS. 6A, 6B, and 6C are cut-away perspectives of an embodiment of the invention providing ambidextrous manipulation of the charging handle.

Figure 7:
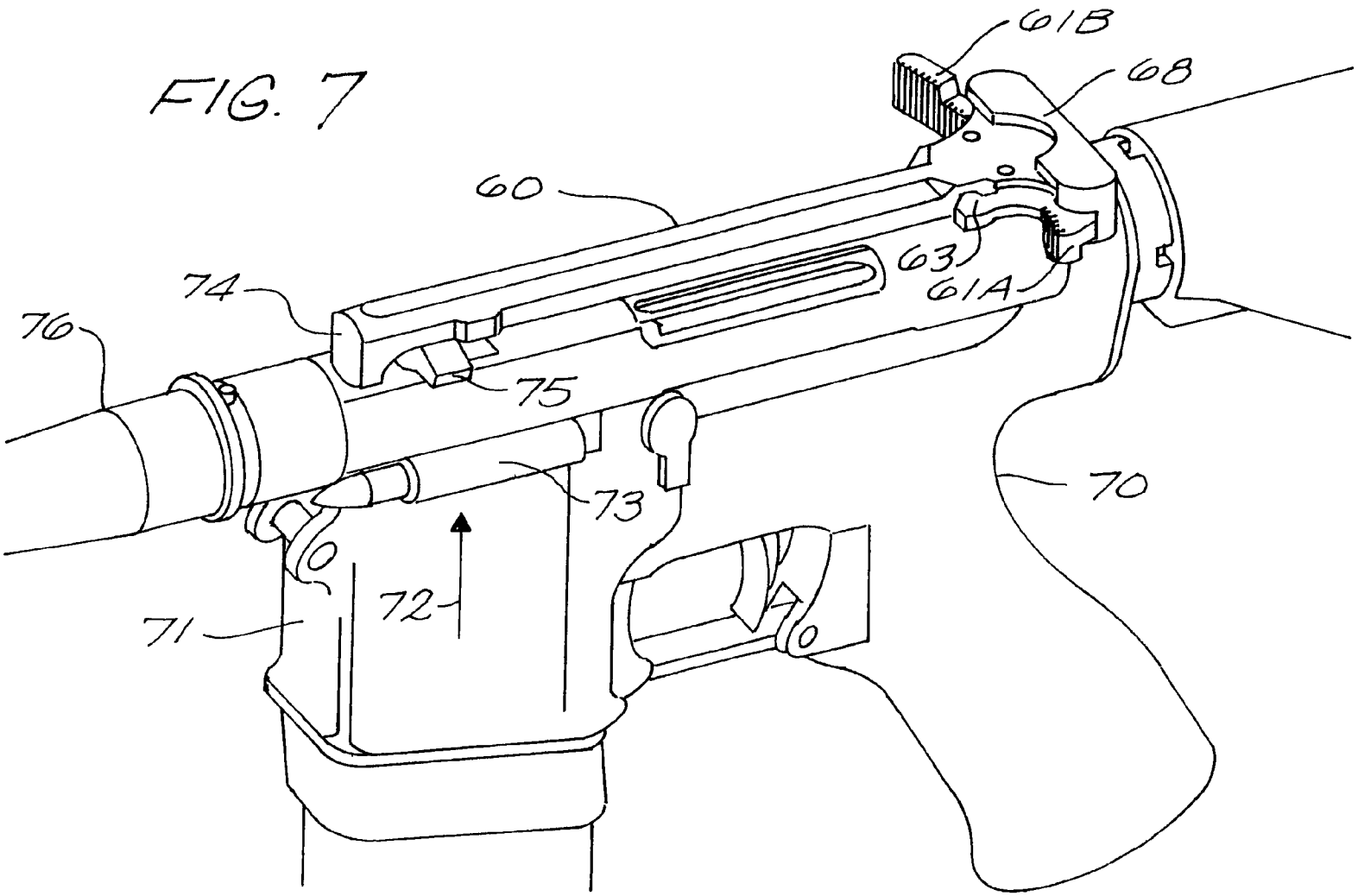

FIG. 7 illustrates the embodiment of the charging handle in conjunction with an action mechanism of a firearm.

Figure 8A:
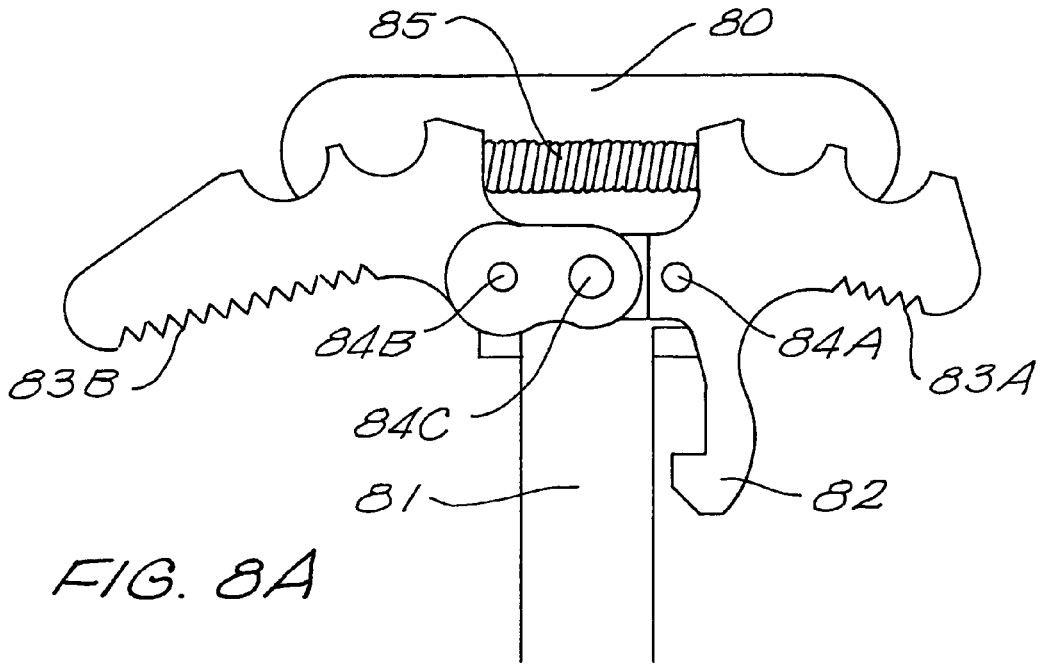
Figure 8B:
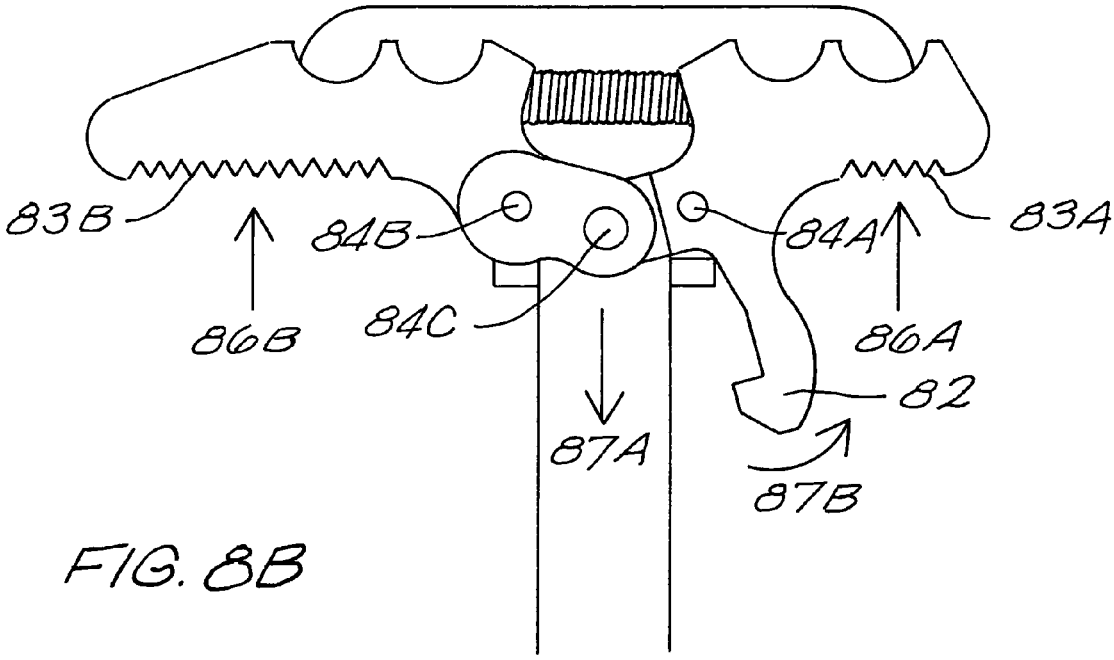

FIGS. 8A and 8B is a partial cutaway view of an alternative embodiment of the invention.

Figure 9A:
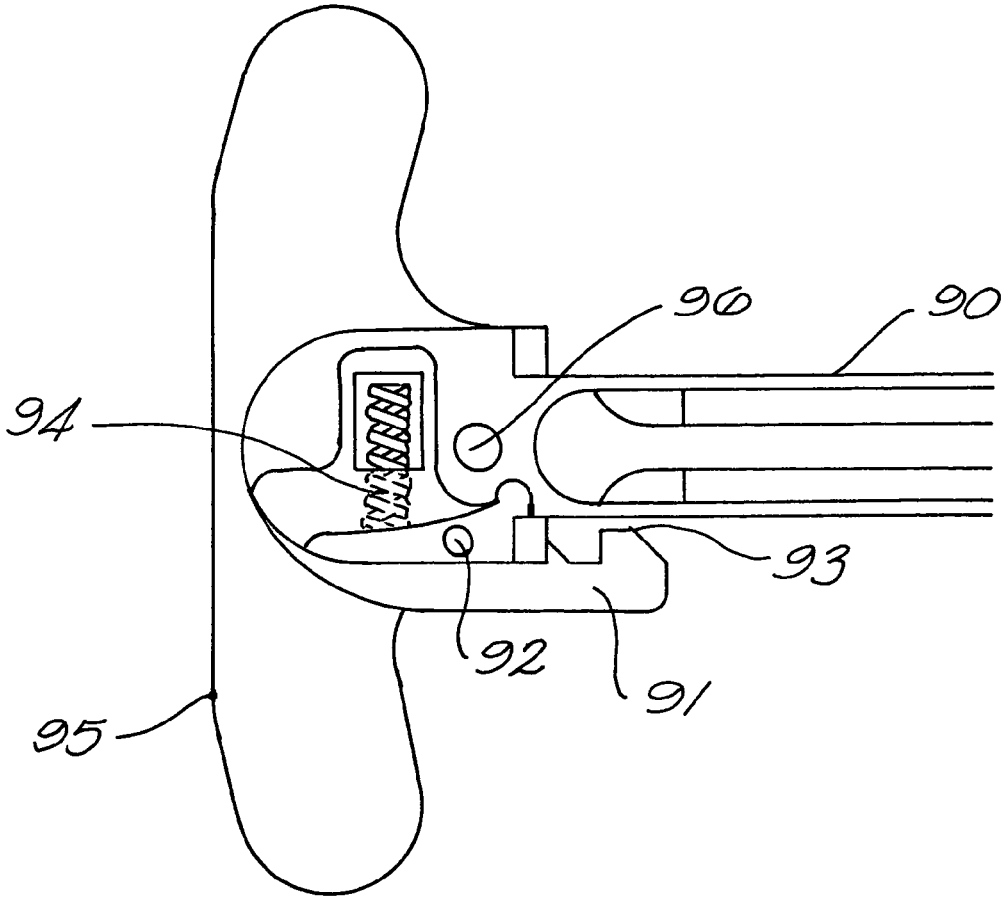

FIG. 9A illustrates an embodiment of the ambidextrous charging handle at-rest; FIG. 9B illustrates the motion when a first handle with withdrawn by an operator; and, FIG. 9C illustrates the motion when the opposing handle is withdrawn by the operator.

DRAWINGS IN DETAIL

Figure 1A:
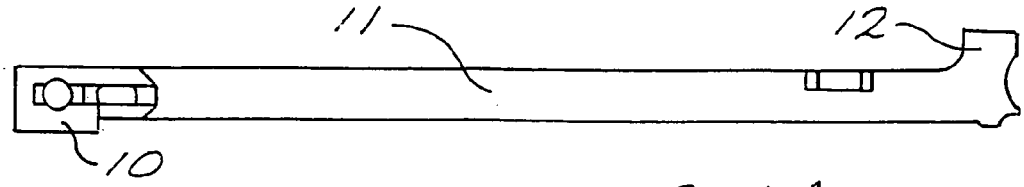
FIGS. 1A and 1B are side and bottom views of the preferred handle mechanism.
Figure 1B:
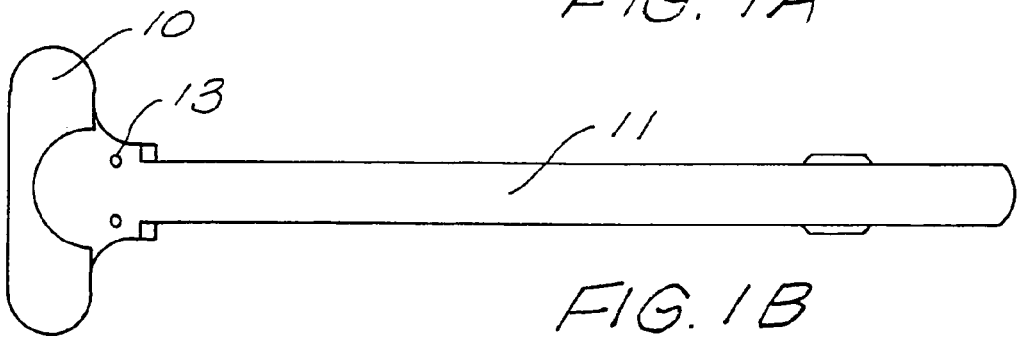

FIGS. 1A and 1B are side and bottom views of the preferred handle mechanism.

The handle mechanism has a handle portion 10 which is designed to be gripped using two fingers in the traditional embodiment. A rod 11 extends to the hook mechanism 12 which is designed to engage the action of the firearm.

As the handle is withdrawn, the hook mechanism engages the bolt mechanism of the firearm and loads a cartridge into the chamber of the firearm.

Hole 13 is used to affix the latch mechanism to the handle mechanism.

Figure 2A:
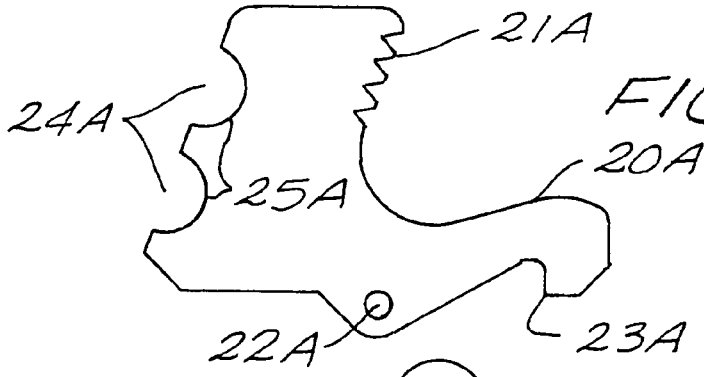
FIGS. 2A and 2B illustrate two different embodiments of the latch mechanism.
Figure 2B:
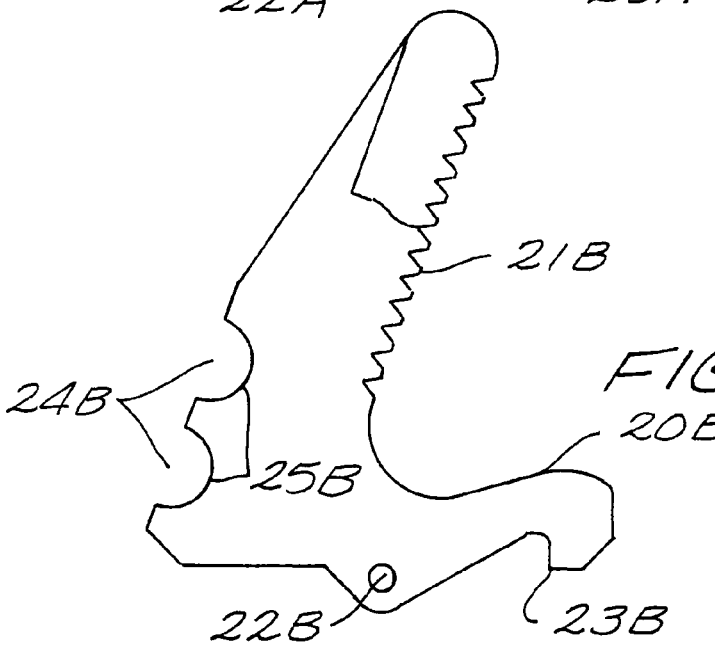

FIGS. 2A and 2B illustrate two different embodiments of the latch mechanism.

These two embodiments are very similar in general construction. Paddles 21A and 21B permit operator pressure to engage the charging handle to that rotation occurs around a pin positioned through hole 22A and 22B. A pin, not shown, secures the latch mechanisms to the hole 13 and handle mechanism described in FIGS. 1A and 1B. This rotation causes hook 23A and 23B to disengage from the firearm, thereby permitting the handle mechanism to be withdrawn to load the weapon.

The embodiments of FIGS. 2A and 2B have reservoirs 24A and 24B which permit debris, such as dirt and water, to collect therein, thereby discouraging the jamming of the mechanism when fouled.

The difference between the embodiment of FIG. 2A and FIG. 2B lies in the length of the paddle 21A and 21B. These different embodiments allow the user of the firearm to select the length of the paddle that best fits their needs.

Note the surfaces 25A and 25B of the two embodiments. These surfaces are designed to engage a stop surface on the handle mechanism during the operator's movement of paddles 21A and 21B, thereby checking the movement so that undue torque is not imparted into the pin within holes 22A and 22B.

Figure 3A:
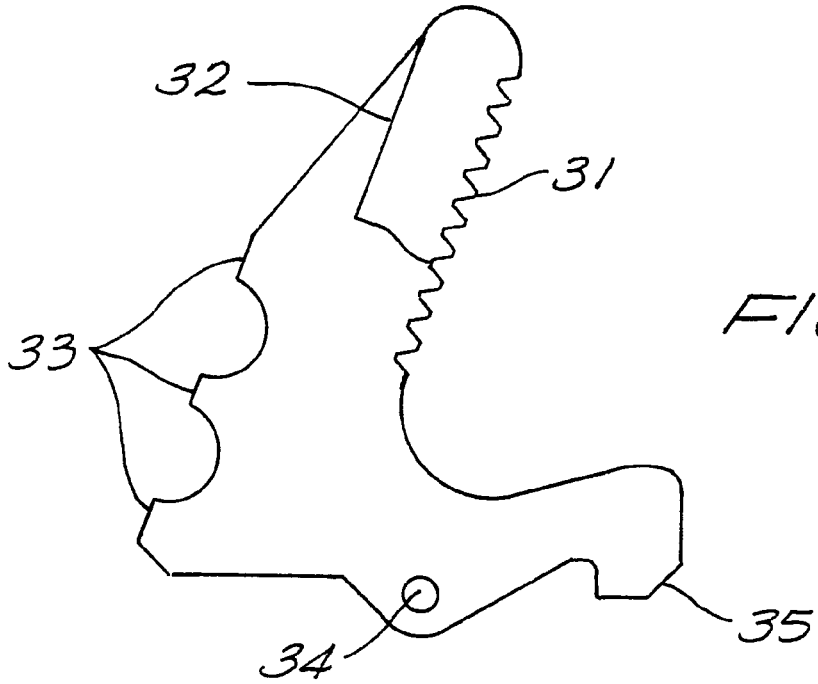
FIGS. 3A and 3B are top and perspective views of the preferred embodiment of the latch mechanism.
Figure 3B:
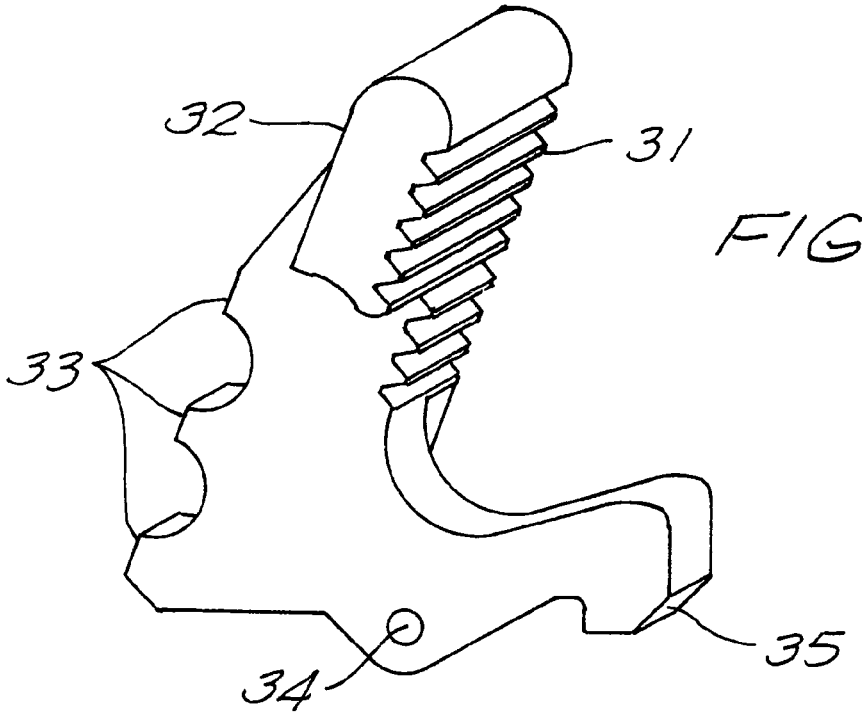

FIGS. 3A and 3B are top and perspective views of the preferred embodiment of the latch mechanism.

As with the embodiments described in FIGS. 2A and 2B, the embodiment of the latch mechanism shown in FIGS. 3A and 3B is also designed to be secured to the handle mechanism via a pin through hole 34 and the latch mechanism is operated by operator pressure upon paddle 31, which causes hook 35 to disengage.

In this embodiment, surfaces 33 are used to check the rotational movement of the latch mechanism, and a second surface 32 is also used to engage a stop surface on the handle portion of the handle mechanism. Surface 33 and surface 32 are configured to engage their respective stop surfaces at the same time, to provide even more durability for the assembly since torque caused during operator operation of paddle 31 is spread to the surfaces 33 and surface 32.

Figure 4A:
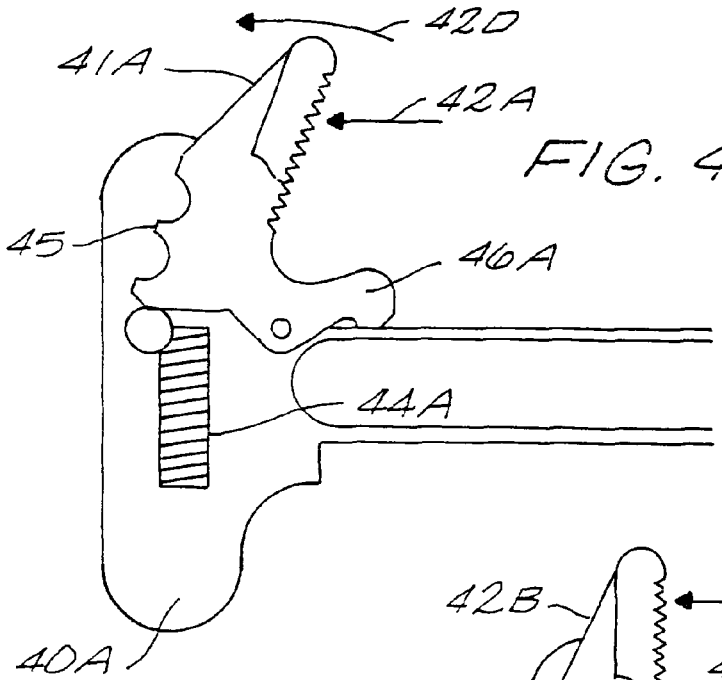
FIGS. 4A and 4B illustrate the charging handle assembly in operation.
Figure 4B:
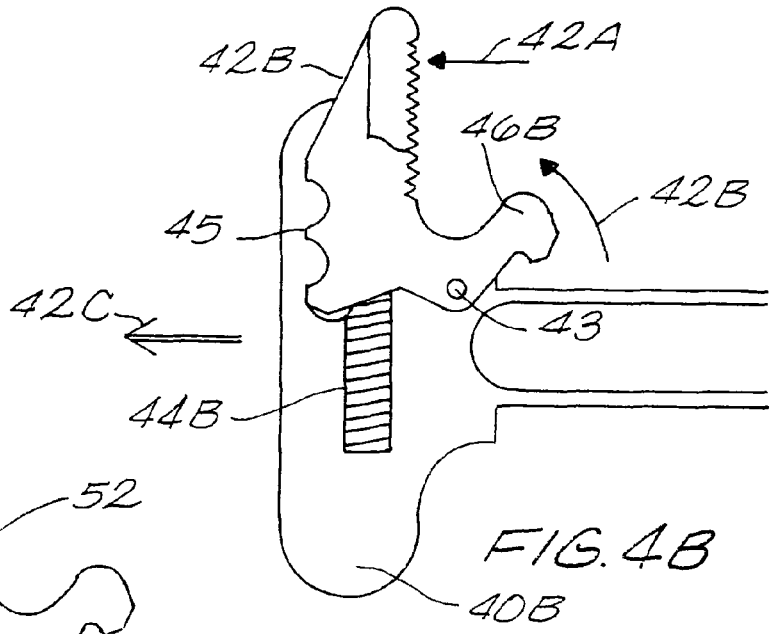

FIGS. 4A and 4B illustrate the charging handle assembly in operation.

FIG. 4A shows the charging handle assembly in a latched position. Hook 46A is positioned to engage the firearm and prevent the charging handle from moving. Latch mechanism 41A is maintained in this position via spring 44A. To disengage hook 46A, the operator provides pressure, as illustrated by arrow 42A which causes the latch mechanism 41A to rotate around pin 43 and move as indicated by arrow 42D.

This rotation around pin 43 results in the arrangement illustrated in FIG. 4B. Latch mechanism 41B has rotated because of the pressure 42A so that the rear surface of latch mechanism 41B engages stop 45 contained within handle 40B. Additionally, hook 46B has now moved as indicated by arrow 42B; and, pressure 42A causes the entire assembly to move as indicated by arrow 42C.

When the operator releases pressure 42A, spring 44B, now in a compressed state, cause the latch mechanism to rotate forward so that hook 46B is again positioned to engage the firearm.

In this manner, minimal torque is applied to pin 43 as the rear surface of latch mechanism 41B and stop surface 45 bear the majority of the pressure caused by the operator during operation of the charging handle.

Figure 5:
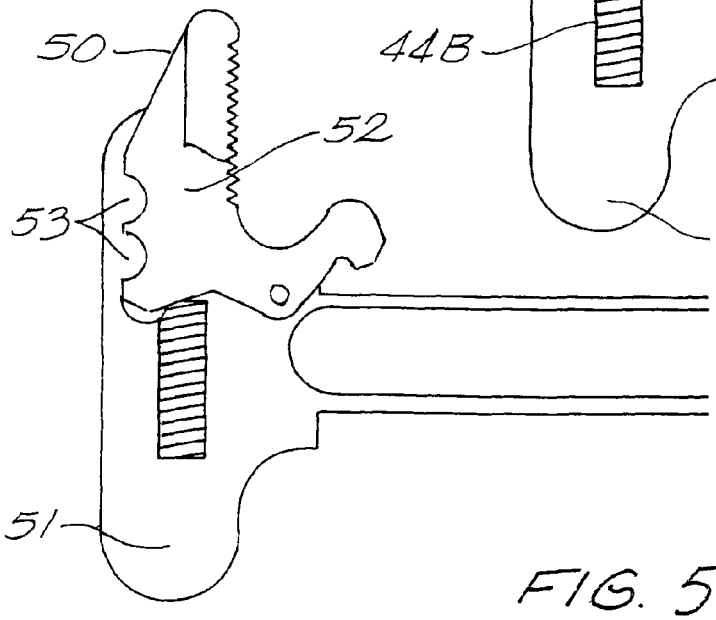
FIG. 5 illustrates the embodiment of the invention having purging openings.

FIG. 5 illustrates the embodiment of the invention having purging openings.

In this embodiment of the invention, latch mechanism 50 has reservoirs 52 positioned along it rear surface as first described relative to FIGS. 3A and 3B. When latch mechanism 50 is moved to the rear, thereby operating charging the charging handle, the rear surface of latch mechanism 50 engages a stop surface of handle 51, and reservoirs 52 are aligned with purging openings 53. Purging openings 53 permit dirt and water to escaped from handle 51 to the movement of latch mechanism 50 is not impaired.

In another embodiment, the purging openings are below the reservoirs, allowing gravity to expunge the debris collected in the reservoirs.

FIGS. 6A, 6B, and 6C are cut-away perspectives of an embodiment of the invention providing ambidextrous manipulation of the charging handle.

Referring to FIG. 6A, charging handle 68 has a rod member 60 which is used to retract the action mechanism of the firearm for the placement of the bullet. At the end of handle 68 is a handle portion which includes a first lever 64A which is rotationally mounted via pin 69A to charging handle 68. Lever 64A includes a finger surface 61A which is accessible outside the cover (shown only in cutaway view for clarity) of the charging handle for operator manipulation. Further, lever 61A includes a prong/finger 62A.

A second lever MB is swivelly mounted to charging handle 68 via pin 69B. Lever 64B also includes a finger surface 61B positioned outside the cover of the charging handle for operator manipulation. Prong 62B is extends behind prong 62A and is intended to work in a cam relationship therewith.

Spring 65 maintains lever 64A and MB in a dormant or locked state until user pressure is applied to either finger surface 61A or 61B. In a locked state, locking member/mechanism 63 engages the side of an action mechanism (not shown).

The mechanics of operator pressure on finger surface 61A is shown in FIG. 6B. Operator pressure 66A on finger surface 61A causes lever 64A to rotate around pin 69A, moving locking mechanism 63 as indicated by arrow 67A; thereby allowing charging handle 68 freedom to move and engage the action mechanism (not shown).

Pressure on the opposing lever 64B is illustrated in FIG. 6C. Operator pressure 66B on finger surface 61B causes lever 64B to rotate around pin 69B, causing prong/finger 69B to create pressure indicated by arrow 66C against prong/finger 62A. Pressure 66C causes lever 64A to rotate around pin 69A and move locking member/mechanism 63 as indicated by arrow 67A into an unlocked condition.

In this manner, the user is able to apply pressure either on the left or right side of charging handle 68 and unlock the charging handle from the action mechanism.

FIG. 7 illustrates the embodiment of the charging handle in conjunction with an action mechanism of a firearm. This illustration, for clarity purposes, does not illustrate the entire action mechanism which is well known to those of ordinary skill in the art.

Charging handle 68 is positioned partially within action mechanism 70 with the rear portion of the charging handle 68 exposed for operator manipulation. Rod member 60 has one end configured 74 to engage a portion 75 of the action mechanism 70 such that by pulling back on charging handle 68, bullets 73 from magazine 71 are moved as indicated by arrow 72 into line with barrel 76 and be ready for firing by action member 70.

Finger surfaces 61A and 61B are exposed allowing the operator to engage either one when withdrawing the charging handle 68. In this manner, a single motion causes locking member 63 to be disengaged from the action and the bullet 73 is in proper position for firing.

FIGS. 8A and 8B is a partial cutaway view of an alternative embodiment of the invention. Referring to FIG. 8A, charging handle 80 includes a rod member 81 which is configured at a distal end to engage the action mechanism of the firearm as described earlier but not shown in this illustration.

Finger member 83A is swivelly connected to the charging handle 80 via pin 84A; in like fashion, finger member 83B is swivelly connected to the charging handle 80 via pin 84B. Further, finger member 83A is swivelly connected to finger member 83B via pin 84C.

In a dormant state, spring 85 maintains finger members 83A and 83B in a position such that locking mechanism 82 engages the edge of the action mechanism as described earlier.

In the preferred structure for this embodiment, a portion of finger member 83A is sandwiched between two panels of forger member 83B near pin 84C to provide enhanced structural integrity. In another structure, finger member 83B is sandwiched by finger member 83A in like fashion.

FIG. 8B illustrates the movement when forces are placed on either finger members 83A or 83B.

When the operator/user applies a pulling force 86A on finger member 83A, finger member 83A rotates around pin 84A, moving locking mechanism 82 as indicated by arrow 87B into an unlocked position. Note that this motion also translates into motion 87A which moves finger member 83B around pin 84B.

When the operator user applies a pulling force 86B on finger member 83B, finger member 83B rotates around pin 84B causing motion indicated by arrow 87A at pin 84C. This causes finger member 83A to also move, thereby moving (as indicated by arrow 87B) locking mechanism 82 into an unlocked state.

One embodiment of this illustration provides for ease in cleaning by positioning pins 84A, 84B, and 84C on an exterior of charging handle 80 so that they are fully exposed.

In this illustration, finger member 83B is significantly larger than finger member 83A. This attribute is also applicable to the embodiments described earlier and allows for difference pressure requirements caused by the mechanism to leveled, allowing the user to apply the same pressure on either lever and obtain the unlocking motion.

FIG. 9A illustrates an embodiment of the ambidextrous charging handle at-rest. This view is from the top. The charging handle of this embodiment, as with the other charging handles above, uses a rod member 90 with a distal end configured to engage the action mechanism (not shown in this illustration). Movement of the rod member causes the action of the firearm to accept a bullet.

The charging handle includes a locking mechanism 91 which is rotatably secured via pin 92. Pin 92 effectively divides the charging handle into a first and second section with a first end 93 of the locking mechanism t configured to secure the charging handle to said action mechanism (not shown)

A spring 94 presses against the locking mechanism 91 to encourage the first end 93 to maintain engagement with the action mechanism (not shown).

A handle 95 is rotatably connected via pin 96 to the rod member 90.

FIG. 9B illustrates the motion when a first handle with withdrawn by an operator. This is a bottom view of the charging handle first illustrated in FIG. 9A.

When the right forger pull 97A in engaged by a user as illustrated by arrow 98A, this motion causes the first pressure surface 99A to engage the first section of the locking mechanism 91 causing motion as illustrated by arrow 98B which causes the locking mechanism to rotate around pin 92 which results in motion 98C, thereby disengaging the first end 93 of the locking mechanism from the action mechanism so that the charging handle can be easily withdrawn.

Referring to FIG. 9C, a bottom view, this figure illustrates the motion when the opposing handle is withdrawn by the operator.

When said left finger pull 97B is engaged by a user, as illustrated by arrow 98D, charging handle 95 rotates around pin 96 as indicated by arrow 98E. This motion causes surface 99B to engage locking mechanism 91 as indicated by arrow 98F. This contact forces end 93 to disengage from the action mechanism (not shown) as illustrated by arrow 98G.

When operator pressure is released, spring 94 returns the charging handle into the configuration sown in FIG. 9A.

In this manner, the charging handle may be used by either a right-handed or a left handed operator. By using two different pressure surfaces, disengagement is assured when either hand is used to pull the charging handle.

The present invention provides for a highly improved charging handle

What is claimed is:

1. A firearm having:

a) an action mechanism configured to accept a bullet and place the bullet in position to be fired; and, b) a charging handle having, 1) a rod member, a first end thereof configured to engage the action mechanism such that movement of the rod member causes the action to accept said bullet and place the bullet in position to be fired;

2) a locking mechanism having a first and second section, a first end thereof configured to secure said charging handle to said action mechanism, between the first section and the second section, said locking mechanism rotatably secured proximate to a second end of said rod member;

3) a spring pressing the second section of said locking mechanism to encourage the first end of said locking mechanism to engage the action mechanism; and, 4) a handle, rotatably connected to the rod member proximate to a second end of said rod member, said handle having a first and a second pressure surface, said handle further having a right and a left finger pull and configured to, A) when said right finger pull in engaged by a user, to press the first pressure surface against the first section of said locking mechanism causing the first end of the locking mechanism to disengage said action mechanism, and, B) when said left finger pull is engaged by a user, to press the second pressure surface against the second section of said locking mechanism causing the first end of the locking mechanism to disengage said action mechanism.

2. The firearm according to claim 1, a) wherein said second section of the locking mechanism includes a protrusion; and, b) wherein said second pressure surface engages said protrusion when said left finger pull is engaged by a user.

3. The firearm according to claim 2, wherein said locking mechanism passes force from said spring into said handle to encourage said handle into a passive state.

4. The firearm according to claim 3, wherein when said first pressure surface engages the first section of said locking mechanism, said second pressure surface is simultaneously moved away from the second section of the locking mechanism.

5. The firearm according to claim 4, wherein when said second pressure surface engages the second section of the locking mechanism, said first pressure surface is simultaneously moved away from the first section of the locking mechanism.

6. The firearm according to claim 4, wherein when said second pressure surface engages the second section of the locking mechanism, said first pressure surface is simultaneously moved away from the first section of the locking mechanism.

7. A charging handle for a firearm comprising:

a) a rod member, a first end thereof configured to engage an action mechanism of said firearm such that movement of the rod member causes the action to accept a bullet and place the bullet in position to be fired;

b) a locking mechanism having a first and second section, a first end thereof configured to secure said charging handle to said action mechanism, between the first section and the second section, said locking mechanism rotatably secured proximate to a second end of said rod member;

c) a handle, rotatably connected to the rod member proximate to a second end of said rod member, said handle having a first and a second pressure surface, said handle further having a right and a left finger pull and configured to, 1) when said right finger pull in engaged by a user, to press the first pressure surface against the first section of said locking mechanism causing the first end of the locking mechanism to disengage said action mechanism, and, 2) when said left finger pull is engaged by a user, to press the second pressure surface against the second section of said locking mechanism causing the first end of the locking mechanism to disengage said action mechanism.

8. The firearm according to claim 7, a) wherein said second section of the locking mechanism includes a protrusion; and, b) wherein said second pressure surface engages said protrusion when said left finger pull is engaged by a user.

9. The firearm according to claim 8, further including a spring pressing the second section of said locking mechanism to encourage the first end of said locking mechanism to engage the action mechanism; and wherein said locking mechanism passes force from said spring into said handle to encourage said handle into a passive state.

10. The firearm according to claim 9, wherein when said first pressure surface engages the first section of said locking mechanism, said second pressure surface is simultaneously moved away from the second section of the locking mechanism.

11. A charging handle for a firearm comprising:

a) a rod member, a first end thereof configured to engage the action mechanism such that movement of the rod member causes an action of said firearm to accept a bullet;

b) a locking mechanism having a first and second section, a first end thereof configured to secure said charging handle to said action mechanism, between the first section and the second section, said locking mechanism rotatably secured proximate to a second end of said rod member;

c) a spring pressing the second section of said locking mechanism to encourage the first end of said locking mechanism to engage the action mechanism; and, d) a handle, rotatably connected to the rod member proximate to a second end of said rod member, said handle having a first and a second pressure surface, said handle further having a right and a left finger pull and configured to, 1) when said right finger pull in engaged by a user, to press the first pressure surface against the first section of said locking mechanism causing the first end of the locking mechanism to disengage said action mechanism, and, 2) when said left finger pull is engaged by a user, to press the second pressure surface against the second section of said locking mechanism causing the first end of the locking mechanism to disengage said action mechanism.

12. The firearm according to claim 11, c) wherein said second section of the locking mechanism includes a protrusion; and, d) wherein said second pressure surface engages said protrusion when said left finger pull is engaged by a user.

13. The firearm according to claim 12, wherein said locking mechanism passes force from said spring into said handle to encourage said handle into a passive state.

14. The firearm according to claim 13, wherein when said first pressure surface engages the first section of said locking mechanism, said second pressure surface is simultaneously moved away from the second section of the locking mechanism.

15. The firearm according to claim 14, wherein when said second pressure surface engages the second section of the locking mechanism, said first pressure surface is simultaneously moved away from the first section of the locking mechanism.

* * * * *